US006686402B2

(12) United States Patent
Woodson et al.

(10) Patent No.: US 6,686,402 B2
(45) Date of Patent: Feb. 3, 2004

(54) COLD-BOX FOUNDRY BINDER SYSTEMS

(75) Inventors: Wayne D. Woodson, Georgetown, IL (US); H. Randall Shriver, Columbus, OH (US)

(73) Assignee: Ashland Inc., Dublin, OH (US)

( * ) Notice: Subject to any disclaimer, the term of this patent is extended or adjusted under 35 U.S.C. 154(b) by 108 days.

(21) Appl. No.: 09/964,963

(22) Filed: Sep. 27, 2001

(65) Prior Publication Data

US 2003/0066622 A1 Apr. 10, 2003

(51) Int. Cl.[7] ..... B22C 1/22

(52) U.S. Cl. ..... 523/139; 164/16; 164/526; 164/529; 523/145; 523/427; 523/436; 523/438; 523/466

(58) Field of Search ..... 164/16, 526, 529; 523/139, 145, 427, 436, 438, 466

(56) References Cited

U.S. PATENT DOCUMENTS

| | | | | |
|---|---|---|---|---|
| 4,518,723 A | | 5/1985 | Woodson | 523/466 |
| 4,526,219 A | | 7/1985 | Dunnavant et al. | 164/16 |
| 4,806,576 A | * | 2/1989 | Woodson | 523/139 |

* cited by examiner

*Primary Examiner*—Robert Dawson
*Assistant Examiner*—D. Aylward
(74) *Attorney, Agent, or Firm*—David L. Hedden

(57) ABSTRACT

This invention relates to foundry binder systems, which will cure in the presence of sulfur dioxide and a free radical initiator, comprising (a) an epoxy novolac resin; (b) preferably a bisphenol F; (c) an acrylate; and (d) an effective amount of a free radical initiator. The foundry binder systems are used for making foundry mixes. The foundry mixes are used to make foundry shapes (such as cores and molds) which are used to make metal castings.

12 Claims, No Drawings

COLD-BOX FOUNDRY BINDER SYSTEMS

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION (1) Field of the Invention

This invention relates to foundry binder systems, which will cure in the presence of sulfur dioxide and a free radical initiator, comprising (a) an epoxy novolac resin; (b) preferably a bisphenol F; (c) an acrylate; and (d) an effective amount of a free radical initiator. The foundry binder systems are used for making foundry mixes. The foundry mixes are used to make foundry shapes (such as cores and molds) which are used to make metal castings.

(2) Description of the Related Art

Foundry binder systems, which cure with vaporous sulfur dioxide, are known in the art. For instance, U.S. Pat. No. 3,879,339 discloses that certain synthetic resins can be cured in the presence of a free radical initiator and sulfur dioxide. Examples of such resins are furan, urea formaldehyde, and phenol formaldehyde resins. On the other hand, U.S. Pat. No. 4,526,219 discloses a cold-box process for making foundry shapes[1], whereby certain ethylenically unsaturated materials are be cured by a free radical mechanism in the presence of a free radical initiator and vaporous sulfur dioxide.

[1]Typical foundry shapes are cores and molds.

U.S. Pat. No. 4,518,723 discloses a cold-box process for making foundry shapes with foundry binders comprising an epoxy resin. Although the patent broadly covers binder systems based upon epoxy resins alone, it is known that bisphenol A epoxy resins and bisphenol F epoxy resins, cured with $SO_2$ in the presence of a free radical initiator, do not work effectively when used alone in a commercial setting, where high productivity is required. In order for the epoxy resins to be useful in these situations, the epoxy resin must be used in conjunction with an acrylic monomer or polymer, typically trimethyolpropane triacrylate (TMPTA). These binders have excellent tensile strengths and can be used in typical high production core-making facilities.

Typically, these binders are packaged in two parts. One part (Part I) is a mixture of a bisphenol-A epoxy resin (bisphenol-F epoxy resin is also used, but not as commonly) and cumene hydroperoxide (free radical initiator). The other part (Part II) is a mixture of a bisphenol-A epoxy resin, a multifunctional acrylate, and optional components. The multifunctional acrylate is typically trimethyolpropane triacrylate and is typically used in amount of about 15 weight percent to about 20 weight percent based on the amount of epoxy resin, but in some cases is used in an amount of 25 weight percent.

The Part I and Part II of the binder are mixed with a foundry aggregate, typically sand, to form a foundry mix. The total amount of binder used to form the foundry mix is typically from about 0.5 to 2 weight percent based on sand (bos). The foundry mixed is blown or compacted into a pattern where it is gassed with $SO_2$ to produce a cured core or mold. Foundry mixes made with these binders have extended benchlife and foundry shapes made with the binder have excellent physical properties.

Although foundry shapes made with these binders have good tensile strengths, it is often necessary to coat the foundry shapes with a refractory coating prior to use in order to minimize the erosion of the foundry shape during casting. The cured core or mold is immersed into the water-based refractory coating to improve the quality of castings made with the foundry shapes. Because of the moisture in the coating, it is necessary to dry the foundry shapes in an oven to evaporate the water in the refractory coating.

If a conventional gas fired convection oven is used, the coated foundry shapes are typically heated for about 20 minutes at a temperature of about 175° C. to 200° C. Then they are extracted from the oven and allowed to cool, so they can be handled without breaking. If the cool-down time is inadequate, the foundry shapes may crack, sag, or distort when handled. This results in waste and inefficiency because defective foundry shapes cannot be used to cast metal articles.

Recently, there is a growing interest in using microwave ovens to dry coated foundry shapes because drying times can be reduced to 5 minutes or less and post-curing in a conventional oven can be eliminated. The disadvantage of using a microwave oven to dry the coated foundry shapes is that this process degrades the binder (even though the tensile strength of the coated foundry shape is good), and heating is uneven. Because the heating is uneven, the surface temperature of the coated foundry shape depends on the local concentration of water (due to the water in the core wash), and may vary as much as 50° C. from one location to another over the surface of the coated foundry shape. This phenomenon does not occur when coated foundry shapes are dried in conventional ovens. In conventional ovens, the surface temperature of the coated foundry shape varies only by few degrees from one place to another.

An even greater problem with using a microwave oven to dry foundry shapes is the high concentration of water vapor in the oven atmosphere during the drying operation, which is a problem because of the poor air circulation. In current industrial microwave design, the airflow through the microwave oven is only about 5000 cubic feet per minute (cfm), compared to 40,000 cfm in a typical conventional oven. Because of this, the atmosphere in the microwave oven is saturated with moisture, and cores and moulds emerging from the oven are not completely dry. In addition, in the microwave process, steam from the evaporating water is driven through the core, rather than evaporating from the surface as in a conventional oven. This entrained hot moisture degrades the strength of the organic binder. As a result, the coated foundry cores do not survive the microwave process without extensive degradation or warpage, and thus are unacceptable for use.

In current practice, about 90% of the binders cured by the cold-box process using $SO_2$ are based on bisphenol-A epoxy resins exclusively. Coated foundry shapes made with these binders typically cannot be handled when they emerge from the oven. When handled, the foundry shapes often sag, crack, or collapse. The larger the core or mould, the more pronounced this effect. Typically, cooling times of 45–60 minutes are required before the foundry shapes can be handled, which is an unacceptable condition in most foundries.

In a small percentage of cases, binders, cured by the cold-box process using $SO_2$, are based on bisphenol-F epoxy resins exclusively. Bisphenol-F epoxy resin is the diglycidyl ether of bis (hydroxyphenyl)methane, prepared by the condensation of phenol and formaldehyde, and has a functionality of approximately 2.05. Although binders based on bis F epoxy resin show some advantages over bisphenol-A epoxy resins in microwave applications, the foundry shapes emerging from the oven are still soft and subject to distortion or cracking, if stressed before a cool down time of 20 minutes or so, particularly when the foundry shapes are coated with a refractory coating.

In view of the problems associated with drying foundry shapes in conventional ovens and microwave ovens, there is an interest in modifying the binders to reduce cracking of the foundry shapes and reduce drying times.

Examples 16–17 of U.S. Pat. No. 4,518,723 (hereinafter the '723 patent) teach that an epoxy novolac resin EPN-1139, manufactured by Ciba-Geigy Corp, can be used to prepare cores. EPN 1139 is an epoxy novolac resin having an average functionality of about 2.3, an epoxide equivalent weight of about 180, and a viscosity of approximately 50,000 centipoise at 25° C. However, it is noteworthy that in both of these examples, the EPN-1139 is blended with Epon 828 (a bisphenol A epoxy resin) to obtain satisfactory cores. It is also noteworthy that the binder of Example 17 does not contain TMPTA, while the binder of Example 16 only contains 7 weight percent of TMPTA, where said weight percent is based on the weight of the epoxy resin. The '723 patent does not mention the comparative strengths tensile strength, transverse strength, and the impact resistance of coated cores made with binders based upon epoxy resins, where the cores are dried in a conventional oven or microwave oven at elevated temperatures. In fact, it does not even mention the problem associated with making coated cores.

BRIEF SUMMARY OF THE INVENTION

The subject invention relates to foundry binder systems, which cure in the presence of vaporous sulfur dioxide and a free radical initiator, comprising:

(a) 20 to 70 parts by weight of an epoxy novolac resin;

(b) preferably from 1 to 35 parts of bisphenol F to reduce the viscosity of the binder;

(b) 20 to 40 parts by weight of a monomeric or polymeric acrylate monomer; and (d) an effective amount of a free radical initiator, where (a), (b), (c) and (d) are separate components or mixed with another of said components, provided (d) is not mixed with (c), and where said parts by weight are based upon 100 parts of binder.

The foundry binders are used for making foundry mixes. The foundry mixes are used to make foundry shapes, such as cores and molds, which are used to make metal castings.

The use of epoxy novolacs in the $SO_2$ cured binder, instead of epoxy resins based on bisphenol A epoxy resin or bisphenol F epoxy resin alone, improves the hot strength of cores and molds made with the binder, so that the cores and molds hold up better during microwave and conventional oven drying operations. The magnitude of the improvement in performance, as measured by impact penetration resistance, is unexpected. Cores and molds made from the binders described in this invention are much more rigid at typical oven curing temperatures and resist distortion and cracking. Furthermore, the cores can be handled sooner because the cool-down time required is not as long, which increases productivity.

Epoxy novolac resins with functionalities ranging from approximately 2.3 to 3.0, e.g. EPN-1139 having a functionality of 2.3, Epalloy 8250 having a functionality of 2.5 and Epalloy 8330 having a functionality of 3.5 have been shown to be the most effective. These epoxy novolac resins can be processed easily, i.e. because of their viscosity, solution stability, solvent compatibility, and the cores made with the binders exhibit improved hot strength.

One of the benefits of practicing this invention is that foundry shapes, made with the $SO_2$ cured binders, can be immersed in a water-based refractory coating, dried in a microwave or conventional oven, and proceed through assembly operations without distortion or cracking, at higher temperatures than foundry cores made with similar binder systems containing bisphenol A epoxy resins or bisphenol F epoxy resins. This leads to greater manufacturing flexibility and higher productivity in the foundry environment. Also less coating and/or cheaper coatings can be used without sacrificing erosion resistance. This advantage is particularly pronounced when the coated cores and molds are dried in a microwave oven.

The use of bisphenol F in the binder lowers the viscosity of the epoxy novolac resin without degrading the coated core. On the other hand, the use of bisphenol-A epoxy resin in significant amounts causes the core to degrade, when subjected to drying in conventional and microwave ovens, and may result in cores that are not resistant to erosion during casting, unless coated with thicker and/or more expensive coatings. The serious deficiencies of binders based on bisphenol-A epoxy resins in drying operations, especially microwave applications, were not mentioned as a problem in the teachings of the '723 patent.

The binders of the subject invention have a combination of benefits not found in the binders described in the prior art. The binders have viscosities that are useful for making cores in a manufacturing setting where high productivity is required; the binders provide cores that have adequate immediate tensile strength that make them suitable for handling; they have adequate impact strength when cured in a microwave oven, so they can survive the microwave process; and the cores made with the binders have improved resistance to erosion during the casting process.

BRIEF DESCRIPTION OF THE SEVERAL VIEWS OF THE DRAWINGS

Not Applicable.

DETAILED DESCRIPTION OF THE INVENTION

The detailed description and examples will illustrate specific embodiments of the invention will enable one skilled in the art to practice the invention, including the best mode. It is contemplated that many equivalent embodiments of the invention will be operable besides these specifically disclosed. All units are in the metric system and all percentages are percentages by weight unless otherwise specified.

An epoxy resin is a resin having one or more epoxide groups, i.e.,

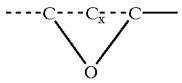

wherein x is zero or a whole number, typically from 1 to 4. Epoxy resins typically used in foundry applications are diglycidyl ethers of bisphenol A. These are made by reacting epichlorohydrin with bisphenol A in the presence of an alkaline catalyst. By controlling the operating conditions and varying the ratio of epichlorohydrin to bisphenol A, products of different molecular weight can be made. Other commonly used epoxy resins include the diglycidyl ethers of other bisphenol compounds such as bisphenol B, F, G and H. Epoxy resins of the type described above based on various bisphenols are available from a wide variety of commercial sources.

The epoxy resin component of the subject invention, however, comprises an "epoxy novolac resin". Epoxy novolac resins are less commonly known and used than other epoxy resins. Epoxy novolac resins are typically prepared by reacting an epihalohydrin, e.g. epichlorohydrin, with the resinous condensate of an aldehyde, e.g. formaldehyde, and either a monohydric phenol, e.g. phenol itself, or a polyhydric phenol, preferably in the presence of a basic catalyst, e.g. sodium or potassium hydroxide, by methods well known in the art. Examples of epoxy novolac resins include epoxy cresol and epoxy phenol novolacs, which are produced by reacting a novolac resin (usually formed by the reaction of orthocresol or phenol and formaldehyde) with epichlorohydrin, 4-chloro-1,2-epoxybutane, 5-bromo-1,2-epoxypentane, 6-chloro-1,3-epoxyhexane and the like.

The epoxy novolac resin (a), or blends of epoxy novolac resins, used in the binders, typically have an average epoxide functionality of at least 2.2 to 3.5, preferably from about 2.3 to about 3.0. Particularly preferred are epoxy novolacs having an average weight per epoxy group of 165 to 200. Although the viscosities of the epoxy novolac resins are high, usually greater than 5,000 cps at 25° C., the epoxy component viscosity is reduced to a workable level when the epoxy novolac resin is mixed with the free radical initiator and/or solvent.

The binder preferably contains some bisphenol F epoxy resin in an amount (typically from 1 to 35 parts by weight based on 100 parts of binder, preferably from 5 to 20 parts by weight), which is useful in reducing the viscosity of the epoxy novolac resin, but does not significantly affect the other required properties of the binders or cores made with the binder. The binder preferably contains sufficient bisphenol F to obtain a binder (or the parts of the binder if the binder is formulated as more than one part), with a viscosity less than 2000 centipoise at room temperature, preferably less than 1500 centipoise, and most preferably less than 900 centipoise.

Although not necessarily preferred, other epoxy resins, such as bisphenol A epoxy resin, may also be added to the binder to lower the costs of the binder. Preferably, not more than 30 weight percent of these other epoxy resins and monomeric bisphenol A are typically used, where the weight percent is based upon the weight percent of the epoxy novolac resin in the binder system. Other epoxy resins, such as bisphenol A epoxy resin and bisphenol F epoxy resin, and monomeric bisphenol compounds, such as bisphenol A, may be added to the binder.

Examples of other epoxy resins include halogen-substituted aliphatic epoxides and diglycidyl ethers of other bisphenol compounds such as bisphenol B, F, G, and H. Examples of halogen-substituted aliphatic epoxides include epichlorohydrin, 4-chloro-1,2-epoxybutane, 5-bromo-1,2-epoxypentane, 6-chloro-1,3-epoxyhexane and the like. The most widely used epoxy resins are diglycidyl ethers of bisphenol A.

The free radical initiator (b) is a peroxide and/or hydroperoxide. Examples include ketone peroxides, peroxy ester free radical initiators, alkyl oxides, chlorates, perchlorates, and perbenzoates. Preferably, however, the free radical initiator is a hydroperoxide or a mixture of peroxide and hydroperoxide. Hydroperoxides particularly preferred in the invention include t-butyl hydroperoxide, cumene hydroperoxide, paramenthane hydroperoxide, etc. The organic peroxides may be aromatic or alkyl peroxides. Examples of useful diacyl peroxides include benzoyl peroxide, lauroyl peroxide and decanoyl peroxide. Examples of alkyl peroxides include dicumyl peroxide and di-t-butyl peroxide.

Cumene hydroperoxide and/or a multifunctional acrylate, such as trimethylolpropane triacrylate, may added to the epoxy novolac resin before mixing it with the foundry aggregate. Optionally, a solvent or solvents may be added to reduce system viscosity or impart other properties to the binder system such as humidity resistance. Examples of solvents include aromatic hydrocarbon solvents, such as such as o-cresol, benzene, toluene, xylene, ethylbenzene, and naphthalenes; reactive epoxide diluents, such as glycidyl ether; or an ester solvent, such as dioctyl adipate, rapeseed methyl ester, and the like, or mixtures thereof. If a solvent is used, sufficient solvent should be used so that the resulting viscosity of the epoxy resin component is less than 1,000 centipoise, preferably less than 400 centipoise. Generally, however, the total amount of solvent is used in an amount of 0 to 25 weight percent based upon the total weight of the epoxy resin.

The reactive unsaturated acrylic monomer, polymer, or mixture thereof (c) contains ethylenically unsaturated bonds. Examples of such materials include a variety of monofunctional, difunctional, trifunctional, tetrafunctional and pentafunctional monomeric acrylates and methacrylates. A representative listing of these monomers includes alkyl acrylates, acrylated epoxy resins, cyanoalkyl acrylates, alkyl methacrylates, cyanoalkyl methacrylates, and difunctional monomeric acrylates. Other acrylates, which can be used, include trimethylolpropane triacrylate, methacrylic acid and 2-ethylhexyl methacrylate. Typical reactive unsaturated acrylic polymers, which may also be used include epoxy acrylate reaction products, polyester/urethane/acrylate reaction products, acrylated urethane oligomers, polyether acrylates, polyester acrylates, and acrylated epoxy resins.

Although solvents are not required for the reactive diluent, they may be used. Typical solvents used are generally polar solvents, such as liquid dialkyl esters, e.g. dialkyl phthalate of the type disclosed in U.S. Pat. No. 3,905,934, and other dialkyl esters such as dimethyl glutarate. Methyl esters of fatty acids, particularly rapeseed methyl ester, are also useful solvents. Suitable aromatic solvents are benzene, toluene, xylene, ethylbenzene, and mixtures thereof. Preferred aromatic solvents are mixed solvents that have an aromatic content of at least 90% and a boiling point range of 138° C. to 232° C. Suitable aliphatic solvents include kerosene. Although the components can be added to the foundry aggregate separately, it is preferable to package the epoxy novolac resin and free radical initiator as a Part I and add to the foundry aggregate first. Then the ethylenically unsaturated material, as the Part II, either alone or along with some of the epoxy resin, is added to the foundry aggregate.

Typically, the amounts of the components used in the binder system are from 20 to 70 weight percent of epoxy novolac resin, preferably from 35 to 60 weight percent; 10 to 25 weight percent of free radical initiator, preferably from 15 to 20 weight percent; and 20 to 35 weight percent of multifunctional acrylate, preferably from 25 to 32 weight percent, where the weight percent is based upon 100 parts of the binder system.

It will be apparent to those skilled in the art that other additives such as silanes, silicones, benchlife extenders, release agents, defoamers, wetting agents, etc. can be added to the aggregate, or foundry mix. The particular additives chosen will depend upon the specific purposes of the formulator.

Various types of aggregate and amounts of binder are used to prepare foundry mixes by methods well known in the art. Ordinary shapes, shapes for precision casting, and refractory shapes can be prepared by using the binder systems and proper aggregate. The amount of binder and the type of aggregate used are known to those skilled in the art. The preferred aggregate employed for preparing foundry mixes is sand wherein at least about 70 weight percent, and preferably at least about 85 weight percent, of the sand is silica. Other suitable aggregate materials for ordinary foundry shapes include zircon, olivine, aluminosilicate, chromite sands, and the like.

In ordinary sand type foundry applications, the amount of binder is generally no greater than about 10% by weight and frequently within the range of about 0.5% to about 7% by weight based upon the weight of the aggregate. Most often, the binder content for ordinary sand foundry shapes ranges from about 0.6% to about 5% by weight based upon the weight of the aggregate in ordinary sand-type foundry shapes.

The foundry mix is molded into the desired shape by ramming, blowing, or other known foundry core and mold making methods. The shape is then cured almost instantaneously by the cold-box process, using vaporous sulfur dioxide as the curing agent (most typically a blend of nitrogen, as a carrier, and sulfur dioxide containing from 35 weight percent to 65 weight percent sulfur dioxide), described in U.S. Pat. Nos. 4,526,219 and 4,518,723, which are hereby incorporated by reference. The shaped article is preferably exposed to effective catalytic amounts of 100 percent vaporous sulfur dioxide, although minor amounts of a carrier gas may also be used. The exposure time of the sand mix to the gas is typically from 0.5 to 3 seconds. Although the foundry shape is cured after gassing with sulfur dioxide, oven drying is needed if the foundry shape is coated with a refractory coating.

The core and/or mold may be formed into an assembly. When making castings, the assembly is typically coated with a water-based refractory coating and passed through a conventional or microwave oven to remove the water from the coating. The item is then ready to be handled for further processing.

ABBREVIATIONS

The abbreviations used in the examples are as follows:

Bis A epoxy resin epoxy resin prepared from bisphenol A having an average molecular weight of about 340 and a functionality of about 1.9.

Bis F epoxy resin epoxy resin prepared from bisphenol F having an average molecular weight of about 340 and a functionality of about 2.05.

CHP cumene hydroperoxide, a free radical initiator.

EPALLOY 8250 an epoxy novolac resin having a functionality of about 2.5, an epoxide equivalent weight of about 173, and a viscosity of approximately 25,000 centipoise at 25° C., sold by CVC Specialty Chemicals.

EPALLOY 8330 an epoxy novolac resin having a functionality of about 3.5, epoxide equivalent weight of about 175, and a viscosity of approximately 250,000 cps at 25° C., sold by CVC Specialty Chemicals.

EPN 1139 an epoxy novolac resin having a functionality of about 2.3, an epoxide equivalent weight of about 180, and a viscosity of approximately 50,000 centipoise at 25° C., sold by Vantico.

TMPTA trimethyolpropane triacrylate, an unsaturated monomer.

EXAMPLES

The lettered examples are comparison examples and the numbered examples are examples that illustrate the practice of this invention. All parts are by weight, unless otherwise indicated.

The impact strength of the coated cores was measured by an "impact penetration test" is used to determine differences in core softness when water-based coated sand cores are subjected to drying in a microwave oven. The impact tester used in this test consists of a sharpened-hardened steel probe, graduated in one-centimeter divisions, attached to a hand-operated spring-loaded mechanism for subjecting the probe to a series of hammer blows of equal impact, which was set at a resistance of 18 pounds. The number of blows required to cause a one centimeter penetration of the probe can be related to the softness of a core when it exits a microwave drying oven. If a higher number of impacts is needed, this indicates that the core retains dimensional accuracy and handling properties. The test procedure is described as follows:

Impact Resistance Test Procedure (1) In a Hobart mixing bowl, 4000 grams of standard 1L5W lake sand are mixed with 1.275% of the binder (epoxy resin and additives pre-blended with the TMPTA) based on sand. Then 17.65% cumene hydroperoxide (based on the weight of epoxy resin component) is added to the sand mixture. This mixture is mixed at speed #1 for two minutes. After two minutes, sand mix is flipped several times to blend any dry sand at the bottom of the bowl into the sand-binder mix. Then the mixture is mixed for another two minutes.

(2) The sand-binder mix is placed in MTB-3 sand magazine and the mix is blown (50 PSI) into rectangular core box (chill wedge), where it is gassed for 2.5 seconds with 100% $SO_2$ (35 PSI) and purged with air for fifteen seconds (40 PSI). The resulting core block (1600–1700 grams in weight) is stripped from the core-box and allowed to set for five minutes.

(3) After aging five minutes, the core block is dipped for three seconds in a water-based foundry coating. The coating used was Ashland Chemical ISOCOTE GCC-1, a water based core coating consisting of a premium grade aluminum silicate, mica, graphite, clay, organic binder, surfactants, and biocide. Excess coating is allowed to drain off for ten seconds. The wet coated core is then place in a standard kitchen microwave (1050 watts on high power). The microwave is turned on and the core is dried for 4.5 minutes.

(4) Immediately upon completion of the drying cycle, the dried core is removed from the oven and the surface temperature is checked with an infrared heat gun (typical temperature is approximately 200° F. after 4.5 minutes).

(5) Once the surface temperature is obtained, the point of the probe of the impact penetration tester is place on the coated surface of the core. Holding the instrument at a right angle to the core surface, the instrument is firmly pressed inwards until a definite impact is felt.[2] The operation is repeated without withdrawing the probe from the surface and the number of impacts necessary to bring the first one-centimeter graduation mark level with the core surface is recorded.[3] Immediately after getting the first impact number, the probe is moved at least one centimeter from initial indentation and the impact test is repeated. The second number of impacts is reported and the average of the two is recorded.

[2]It is important that only the spring loaded hammer in the body of the instrument force the probe into the surface. Therefore, only sufficient pressure should be supplied by the operator to release the hammer mechanism.

[3]Because of the softness of the cores coming out of the microwave, the tension of the hammer mechanism is set to the lowest setting by turning the knurled knob counterclockwise to the fully extended position. At this setting, it requires approximately 7 kilograms of weight to release the spring loaded hammer mechanism.

Comparison Examples A, B, and C

Binders with Little or No TMPTA

Comparative Example A

Binder Containing Epoxy Novolac and No TMPTA

A blend was prepared equivalent to that described in example XVII of U.S. Pat. No. 4,518,723 (Woodson).

| Component | Parts |
|---|---|
| EPN 1139 | 41.46 |
| Methanol | 4.62 |
| Silane | .09 |

This mixture was added to 4000 grams of Manley 1L-5W sand. 13.86 grams of cumene hydroperoxide was then added and mixed according to Example A. This system showed an impact resistance of 2.

Comparative Example B

Binder Containing Epoxy Novolac, Bisphenol A Epoxy Resin, and No TMPTA

A blend was prepared equivalent to a Bis-A epoxy modified system described in Example XVII of U.S. Pat. No. 4,518,723 (Woodson).

| Component | Parts |
|---|---|
| Bis-A epoxy | 20.76 |
| EPN 1139 | 20.76 |
| Methanol | 4.62 |
| Silane | .09 |

This blend was added to 4000 grams of Manley 1L-5W sand. 13.86 grams of cumene hydroperoxide was then added and mixed as previously described. This system had an impact resistance measurement of 0.

Comparative Example C

Binder Containing Epoxy Novolac and a Minor Amount of TMPTA

A blend was prepared equivalent to that described in Example XVI of U.S. Pat. No. 4,518,723 (Woodson).

| Component | Part |
|---|---|
| EPN 1139 | 28.26 |
| Bis-A Epoxy | 9.42 |
| Methanol | 6.0 |
| TMPTA | 4.2 |
| Silane | 0.12 |

The ingredients were pre-blended and added to 4000 grams of Manley 1L-5W lake sand. Then 12 grams of cumene hydroperoxide was added and mixed according to Example A. The system showed an impact resistance of 4.5.

The binders of Comparison Examples A, B, and C produced cores that were unsuitable for any process, which includes a microwave or conventional oven drying operation. These examples demonstrate the need for an adequate amount of acrylic monomer in the binder.

Comparison Example D

Binder Containing TMPTA and Bisphenol A Epoxy Resin

The following ingredients were pre-blended and then added to 4000 parts of Manley 1L5W lake sand:

| Component | Parts |
|---|---|
| Bis-A epoxy Resin | 28.5 |
| TMPTA | 15.0 |
| Dioctyl Adipate | 5.6 |
| Hi Sol 15 | 1.8 |
| Silane | 0.12 |

Nine parts of cumene hydroperoxide was then added to the sand/resin and mixed in accordance with section (1) of the Impact Resistance Test Procedure. This mix was then evaluated for impact resistance in accordance with the above Procedure. The impact resistance was measured at 14.

Comparison Example D demonstrates that cores with adequate impact resistance cannot be made, if bisphenol A epoxy resin is used as the epoxy resin.

Comparison Example E

Binder Containing TMPTA and Bisphenol F Epoxy Resin

Comparison Example D was repeated except that bisphenol F epoxy resin (functionality 2.05) was substituted for bisphenol A epoxy resin (functionality 1.9). This system had an impact resistance of 32.

Comparison Example D demonstrates that cores made with bisphenol F epoxy resin is used as the epoxy resin did not have adequate impact resistance.

Example 1

Binder Containing Epoxy Novolac, Having a Functionality of 2.5, and TMPTA

Example D was repeated except that epoxy novolac 8250 (functionality 2.5) was substituted for bisphenol A epoxy resin. This system had an impact resistance of 65.

Example 1 illustrates that the impact resistance of the core is improved if an epoxy novolac resin and sufficient TMPTA is used in the binder.

Example 2

Binder Containing Epoxy Novolac, Having a Functionality of 3.6, and TMPTA

Example 1 was repeated except that epoxy novolac 8330 (functionality 3.6) was substituted for bisphenol A epoxy resin. This system displayed an impact resistance of 93.

Example 2 illustrates that the impact resistance of the core is improved if an epoxy novolac resin of a higher functionality is used in the binder.

Example 3

Binder Containing Epoxy Novolac, Having a Functionality of 3.6, Bisphenol F Epoxy Resin and TMPTA Example 1 was repeated except that a mixture of 15.75 g bisphenol-F epoxy, 7.5 g epoxy novolac 8250, and 5 g Epoxy Novolac 8330 was substituted for the bisphenol-F epoxy resin component. This mixture has an average functionality of 2.42. The impact resistance of this system was measured at 58, compared to 32 in Example 2.

This example demonstrates that blends of epoxy novolac resins and bisphenol-F epoxy resin can be used to make cores with adequate impact resistance, although the addition of the bisphenol F epoxy resin lowers the impact resistance. Other experiments indicate that the addition of bisphenol A epoxy resin has an even greater detrimental effect on the impact resistance of the cores made with the binder.

Because the impact resistance of the cores made with the binder containing the epoxy novolac resin is improved, these cores will survive microwave and conventional oven drying.

What is claimed is:

1. A foundry mix comprising:

(a) a major amount of a foundry aggregate;

(b) an effective binding amount of a binder system, which will cure in the presence of sulfur dioxide and a free radical initiator, comprising:

(1) 20 to 70 parts by weight of an epoxy novolac resin;

(2) 20 to 40 parts by weight of a monomeric or polymeric acrylate; and (3) an effective amount of a free radical initiator, where (1), (2), and (3) are separate components or mixed with another of said components, provided (3) is not mixed with (2), where said parts by weight are based upon 100 parts of binder system, and wherein said binder system does not contain any bisphenol A epoxy resin.

2. The foundry mix of claim 1, which also contains from 1 to 35 parts by weight of bisphenol F.

3. The foundry mix of claim 2 comprising two parts, wherein Part I comprises (1), and (2), and Part II comprises (3), such that the viscosity of the Part I and Part I is less than 2000 centipoise.

4. The foundry mix of claim 3 wherein the wherein the functionality of the epoxy novolac resin is from about 2.3 to about 3.0.

5. The foundry mix of claim 4 wherein the acrylate is a monomer and the monomer is trimethyolpropane triacrylate.

6. The foundry mix of claim 5 wherein the epoxy novolac has a functionality of at least 2.4.

7. A foundry mix comprising:

(a) a major amount of a foundry aggregate;

(b) an effective binding amount of a binder system, which will cure in the presence of sulfur dioxide and a free radical initiator, comprising:

(1) 20 to 70 parts by weight of an epoxy novolac resin;

(2) 20 to 40 parts by weight of a monomeric or polymeric acrylate;

(3) 1 to 35 parts by weight of bisphenol F; and (4) an effective amount of a free radical initiator, where (1), (2), (3), and (4) are separate components or mixed with another of said components, provided (4) is not mixed with (2), and where said parts by weight are based upon 100 parts of binder system.

8. The foundry mix of claim 7 comprising two parts, wherein Part I comprises (1), (2), and (3), and Part II comprises (4), such that the viscosity of the Part I and Part I is less than 2000 centipoise.

9. The foundry mix of claim 8 wherein the wherein the functionality of the epoxy novolac resin is from about 2.3 to about 3.0.

10. The foundry mix of claim 9 wherein the acrylate is a monomer and the monomer is trimethyolpropane triacrylate.

11. The foundry mix of claim 10 wherein the epoxy novolac has a functionality of at least 2.4.

12. The foundry mix of claim 11 wherein the amount of bisphenol F is from 5 to 35 parts by weight.

* * * * *